US011692679B1

(12) United States Patent
Yang

(10) Patent No.: US 11,692,679 B1
(45) Date of Patent: Jul. 4, 2023

(54) WATERFALL STRING LIGHT

(71) Applicant: Chengzhuo Yang, Taizhou (CN)

(72) Inventor: Chengzhuo Yang, Taizhou (CN)

(73) Assignee: Chengzhuo Yang, Taizhou (CN)

( * ) Notice: Subject to any disclaimer, the term of this patent is extended or adjusted under 35 U.S.C. 154(b) by 0 days.

(21) Appl. No.: 18/074,096

(22) Filed: Dec. 2, 2022

(51) Int. Cl.
*F21S 4/10* (2016.01)
*F21V 23/06* (2006.01)

(52) U.S. Cl.
CPC ..... *F21S 4/10* (2016.01); *F21V 23/06* (2013.01)

(58) Field of Classification Search
CPC .... F21S 4/00; F21S 4/10; F21V 23/06; F21Y 2115/10; F21W 2121/00; F21W 2121/006
See application file for complete search history.

(56) References Cited

U.S. PATENT DOCUMENTS 6,474,841 B1 * 11/2002 Rahman ..... F21V 19/0005 362/249.14
11,221,130 B1 * 1/2022 Tsai ..... F21V 23/001
2005/0286255 A1 * 12/2005 Sugar ..... F21S 4/10 362/653

FOREIGN PATENT DOCUMENTS

CN 205596428 U 9/2016
CN 214198255 U 9/2021
CN 217178333 U 8/2022

* cited by examiner

*Primary Examiner* — Peggy A Neils
(74) *Attorney, Agent, or Firm* — Nitin Kaushik

(57) ABSTRACT

The present disclosure provides a decorative light, and aims to provide a waterfall string light. A printed circuit board (PCB), a counter circuit, a square wave generation circuit, and a protection circuit are arranged in a control module. The control module is configured to control main light beads to be normally on or intermittently flicker. The counter circuit is configured to control the number of the main light beads that are normally on when a main light strip is powered on. The square wave generation circuit is configured to control a flicker rate of the main light beads. The protection circuit is configured to automatically cut off the circuit when the light strip fails. The counter circuit is configured to perform high and low level control on corresponding pins by counting the number of pulses to achieve the normally on and flicker of the main light beads.

3 Claims, 1 Drawing Sheet

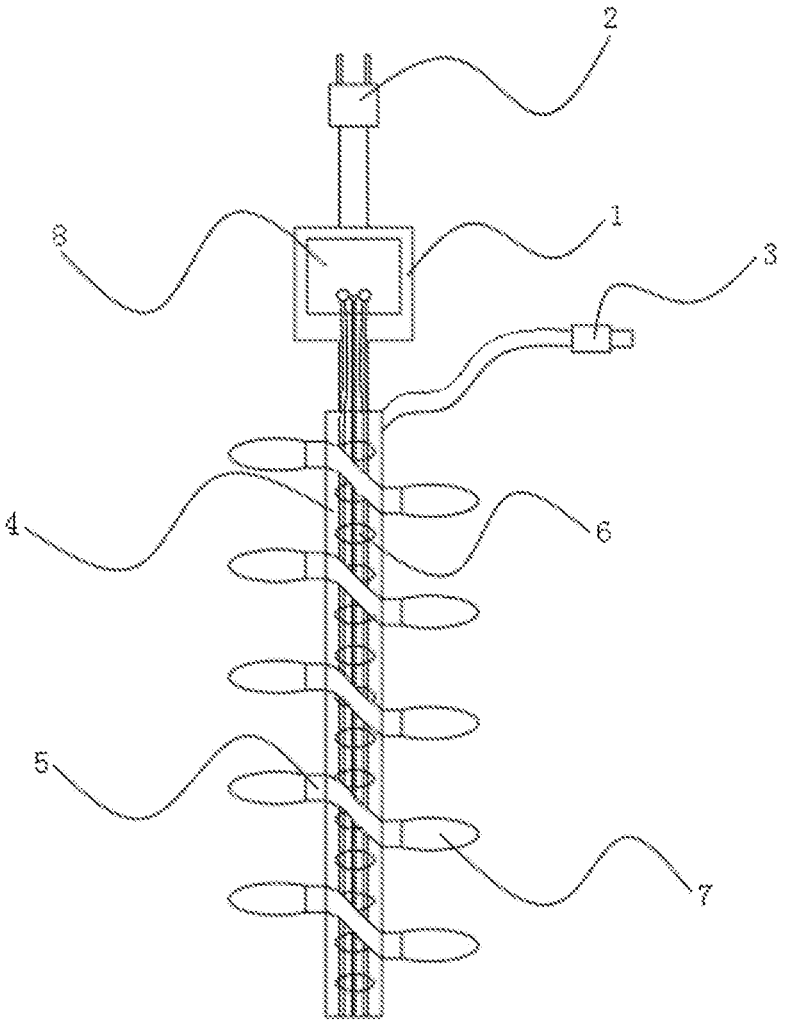
2
1
8
3
4
6
5
7

WATERFALL STRING LIGHT

TECHNICAL FIELD

The present disclosure relates to the field of decorative lights, in particular to a waterfall string light.

BACKGROUND

Waterfall lights widely applied to buildings are mostly installed on storefronts and shop signs to form a certain visual effect, and may be turned on or off according to a set sequence and time under the control of a control system. However, existing waterfall lights have low applicability due to incapability of adjusting a frequency of turning on or off light beads, and cannot provide a more beautiful lighting decoration effect due to single design. Therefore, a waterfall string light with adjustable flicker mode and flicker frequency is urgently needed.

SUMMARY

In view of the deficiencies existing in the prior art, an objective of the present disclosure is to provide a waterfall string light.

To achieve the above objective, the present disclosure provides the following technical solution: a waterfall string light, including a control module, a power plug, a universal serial bus (USB) connector, a main light strip, an auxiliary light strip, main light beads arranged on the main light strip, and auxiliary light beads arranged on the auxiliary light strip, where the USB connector is connected to the auxiliary light strip, the power plug is connected to the main light strip, the control module is arranged between the power plug and the main light strip, the auxiliary light strip is spirally wound around the main light strip, a printed circuit board (PCB), a counter circuit, a square wave generation circuit, and a protection circuit are arranged in the control module, the counter circuit, the square wave generation circuit, and the protection circuit are arranged on the PCB, the control module is configured to control the main light beads to be normally on or intermittently flicker, the counter circuit is configured to control the number of the main light beads that are normally on when the main light strip is powered on, the square wave generation circuit is configured to control a flicker rate of the main light beads, and the protection circuit is configured to automatically cut off the circuit when the light strip fails.

Further, the main light beads are uniformly and equidistantly arranged on the main light strip, connecting wires are arranged on the main light strip, the square wave generation circuit is connected to the counter circuit and is configured to provide a clock for the counter circuit, the counter circuit is connected to the main light beads via the connecting wires, and the counter circuit is configured to perform high and low level control on corresponding pins by counting the number of pulses to achieve the normally on and flicker of the main light beads.

Further, the square wave generation circuit is set as a time base generation circuit TLC555.

By adopting the above technical solution, the auxiliary light strip is normally on when powered on, the main light strip flickers like a waterfall when powered on, and the auxiliary light strip is wound outside the main light strip to form a decorative lighting effect with the main light strip; the control module may control a flicker model and the flicker rate of the main light strip to achieve a use effect closer to the environment; the protection circuit may cut off power supply when the main light strip fails to ensure that the PCB will not be burned out; and meanwhile, the main light strip and the auxiliary light strip have working voltages conforming to common living standards and are fast, simple and convenient to use.

BRIEF DESCRIPTION OF DRAWINGS

FIG. 1 is a schematic structural diagram of an embodiment of a waterfall string light according to the present disclosure, in which reference numerals are follows: 1: control module; 2: power plug; 3: universal serial bus (USB) connector, 4: main light strip; 5: auxiliary light strip; 6: main light bead; 7: auxiliary light bead; and 8: printed circuit board (PCB).

DETAILED DESCRIPTION OF THE EMBODIMENTS

An embodiment of a waterfall string light according to the present disclosure is further described with reference to FIG. 1.

For ease of explanation, the spatial relative terms such as "up". "down", "left", and "right" are used in the embodiment to explain the relationship between one element or feature and another element or feature shown in the FIGURE. It should be understood that in addition to the orientation shown in the FIGURE, the spatial terms are intended to include different orientations of the device in use or operation. For example, if the device in the FIGURE is inverted, the element described as being positioned "below" other element or feature will be positioned "above" other element or feature. Therefore, the exemplary term "below" may include both an upper and a lower orientation. The device may be positioned in other way (rotated by 90° or positioned in other orientation), and the spatial relative description used here may be explained accordingly.

Moreover, the relational terms such as "first" and "second" are only used to distinguish one component with the same name from another, and do not necessarily require or imply any such actual relationship or order between these components.

A waterfall string light includes a control module 1, a power plug 2, a universal serial bus (USB) connector 3, a main light strip 4, an auxiliary light strip 5, main light beads 6 arranged on the main light strip 4, and auxiliary light beads 7 arranged on the auxiliary light strip 5. The USB connector 3 is connected to the auxiliary light strip 5. The power plug 2 is connected to the main light strip 4. The control module 1 is arranged between the power plug 2 and the main light strip 4. The auxiliary light strip 5 is spirally wound around the main light strip 4. A printed circuit board (PCB) 8, a counter circuit, a square wave generation circuit, and a protection circuit are arranged in the control module 1. The counter circuit, the square wave generation circuit, and the protection circuit are arranged on the PCB 8. The control module 1 is configured to control the main light beads 6 to be normally on or intermittently flicker. The counter circuit is configured to control the number of the main light beads 6 that are normally on when the main light strip 4 is powered on. The square wave generation circuit is configured to control a flicker rate of the main light beads 6. The protection circuit is configured to automatically cut off the circuit when the light strip fails. The main light strip 4 and the auxiliary light strip 5 are separately arranged and respectively connected to different power supplies. When the waterfall string light is used, the main light strip 4 may be controlled to form a waterfall light or the auxiliary light strip 5 may be controlled to form a normally-on decorative light or the main light strip 4 and the auxiliary light strip 5 may be turned on simultaneously to form the waterfall light and the normally-on decorative light, so as to form the beautiful waterfall string light. The auxiliary light strip 5 is normally on after being turned on, and the main light strip 4 forms the waterfall light after being turned on. The auxiliary light strip 5 is spirally wound around the main light strip 4. Three electric wires are arranged in the main light strip 4 and are respectively connected to the counter circuit and the square wave generation circuit in the control module 1. During actual use, the main light beads 6 arranged on the main light strip 4 flicker regularly through the control module 1 according to a flicker rule that one part of the main light beads 6 flicker continuously and the other part of the main light beads 6 flicker like a waterfall. The number of the light beads, flickering like the waterfall, between the nearest two adjacent main light beads 6 flickering continuously is set to be n, and n is controlled by the counter circuit. The counter circuit may adjust the number of the main light beads 6 flickering continuously on the main light strip 4 to adjust the density of the light beads flickering like the waterfall, so as to create waterfall string lights with different visual effects. Between any two main light beads 6 flickering continuously, the rest of the light beads flickering like the waterfall flicker in sequence from top to bottom at the same time. The square wave generation circuit is configured to control and adjust the flicker rate of the light beads flickering like the waterfall. The light beads flickering like the waterfall flicker cyclically between the two main light beads 6 flickering continuously. According to different environments, the rate of cyclic flicker may be adjusted to create a faster rhythm or slower atmosphere.

The main light beads 6 are uniformly and equidistantly arranged on the main light strip 4. The connecting wires are arranged on the main light strip 4. The square wave generation circuit is connected to the counter circuit and is configured to provide a clock for the counter circuit. The counter circuit is connected to the main light beads 6 via the connecting wires. The counter circuit is configured to perform high and low level control on corresponding pins by counting the number of pulses to achieve the normally on and flicker of the main light beads 6. The counter circuit is a decimal counter CD4017. The square wave generation circuit is a time base circuit TLC555. Both the CD4017 and the TLC555 may work normally under power supply of 35 V to provide the clock for the counter circuit. Output pins of the counter circuit are connected to the main light beads 6, respectively. According to the counted number of the pulses, when the corresponding pins of a counter output a high level, the corresponding main light beads 6 are turned on, and when the remaining pins output a low level, the corresponding main light beads 6 are not turned on. By controlling the main light beads 6 to be turned on or off in sequence, recounting is performed after counting to a maximum value, and the process is repeated to achieve the effect of the waterfall light. A square wave generation frequency of the square wave generation circuit may be adjusted to adjust a flow rate of the waterfall light. The protection circuit may cut off the power supply when the main light strip 4 fails to ensure that the PCB 8 will not be burned out.

The above is only the preferred embodiment of the present disclosure, and is not intended to limit the present disclosure. Common changes and substitutions made by those skilled in the art within the scope of the technical solution of the present disclosure should be included in the scope of protection of the present disclosure.

What is claimed is:

1. A waterfall string light, comprising a control module, a power plug, a universal serial bus (USB) connector, a main light strip, an auxiliary light strip, main light beads arranged on the main light strip, and auxiliary light beads arranged on the auxiliary light strip, wherein the USB connector is connected to the auxiliary light strip, the power plug is connected to the main light strip, the control module is arranged between the power plug and the main light strip, the auxiliary light strip is spirally wound around the main light strip, a printed circuit board (PCB), a counter circuit, a square wave generation circuit, and a protection circuit are arranged in the control module, the counter circuit, the square wave generation circuit, and the protection circuit are arranged on the PCB, the control module is configured to control the main light beads to be normally on or intermittently flicker, the counter circuit is configured to control the number of the main light beads that are normally on when the main light strip is powered on, the square wave generation circuit is configured to control a flicker rate of the main light beads, and the protection circuit is configured to automatically cut off the circuit when the light strip fails.

2. The waterfall string light according to claim 1, wherein the main light beads are uniformly and equidistantly arranged on the main light strip, connecting wires are arranged on the main light strip, the square wave generation circuit is connected to the counter circuit and is configured to provide a clock for the counter circuit, the counter circuit is connected to the main light beads via the connecting wires, and the counter circuit is configured to perform high and low level control on corresponding pins by counting the number of pulses to achieve the normally on and flicker of the main light beads.

3. The waterfall string light according to claim 1, wherein the square wave generation circuit is set as a time base generation circuit TLC555.

* * * * *